United States Patent [19]

Hatanaka

[11] Patent Number: 4,903,047

[45] Date of Patent: Feb. 20, 1990

[54] ELECTROPHOTOGRAPHIC PRINTER

[75] Inventor: Sunao Hatanaka, Takizawa, Japan

[73] Assignee: Alps Electric Co., Ltd., Tokyo, Japan

[21] Appl. No.: 307,860

[22] Filed: Feb. 7, 1989

[30] Foreign Application Priority Data

Mar. 24, 1988 [JP] Japan ..... 63-37641[U]

[51] Int. Cl.[4] ..... G03G 15/00

[52] U.S. Cl. ..... 346/153.1; 355/312; 355/321; 271/94; 271/5

[58] Field of Search ..... 346/153.1; 355/312, 355/321; 271/90, 91, 94, 3.1, 5, 96

[56] References Cited

U.S. PATENT DOCUMENTS

| | | | |
|---|---|---|---|
| 3,625,508 | 12/1971 | Shiragai et al. | 271/96 |
| 3,826,568 | 7/1974 | Hudson | 355/312 X |
| 4,421,306 | 12/1983 | Muka | 271/5 |
| 4,469,319 | 9/1984 | Robb et al. | 271/3.1 |
| 4,589,768 | 5/1986 | Iwata et al. | 355/312 X |
| 4,664,507 | 5/1987 | Fukae et al. | 355/312 |
| 4,703,923 | 11/1987 | Anderson et al. | 271/3.1 |

*Primary Examiner*—A. C. Prescott

*Attorney, Agent, or Firm*—Guy W. Shoup; Stephen L. Malaska

[57] ABSTRACT

An electrophotographic printer having a photosensitive drum disposed in a body for transferring an electrostatically adhered toner to the lower surface of a sheet, a fixing unit disposed at the downstream side of the photosensitive drum for fixing the toner transferred to the sheet, and a suction conveying mechanism disposed between the photosensitive drum and the fixing unit for conveying the sheet transferred with the toner by the photosensitive drum by sucking the sheet transferred with the toner from above comprising a retaining roller rotatably pressed in contact with the lower surface of the conveyor belt of the suction conveying mechanism. Thus, the printer can positively and stably convey a sheet of all types including an envelope toward the fixing unit when the sheet transferred with a toner image to its lower surface is conveyed while the sheet is sucked from the upper surface.

5 Claims, 2 Drawing Sheets

ELECTROPHOTOGRAPHIC PRINTER

BACKGROUND OF THE INVENTION

1. Field of the Invention

This invention relates to an electrophotographic printer and, more particularly, to an electrophotographic printer adapted to print a toner image adhered electrostatically to a photosensitive member such as a photosensitive drum on the lower surface of a sheet by transferring the image thereto.

2. Description of the Prior Art

FIG. 2 shows an example of an electrophotographic printer. Sheet cassettes 3 for containing sheets 2 of different sizes are detachably attached to one end of a printer body 1 of box shape as a housing, and a hopping roller 4*a* for taking one by one the sheets 2 in the cassettes 3 and a feed roller 4*b* for conveying the sheets 2 are arranged near the cassettes 3. A sheet conveyor for connecting the cassettes 3 to an exhausted sheet tray 29 to be described later is disposed on a substantially horizontal flat surface. A cylindrical photosensitive drum 5 is disposed in the body 1. On the outer periphery of the photosensitive drum 5 are sequentially arranged according to the rotating direction of the drum a corona charger 6 as a state control mechanism for uniformly applying charge to the photosensitive drum 5 to set the drum 5 to a writable state, an LED head 7 as an optically writing mechanism for forming an electrostatic latent image on the photosensitive drum 5, a developing unit 8 for depositing toner to the electrostatic latent image formed on the photosensitive drum 5 to visualize the latent image, a transfer unit 9 for transferring the toner to the lower surface of the sheet 2, a separating corona charger 10 disposed adjacently to the downstream side of the sheet 2 of the transfer unit 9 with respect to the conveying direction for separating the sheet transferred with the toner from the photosensitive drum 5, an electric eliminator 11 for removing the remaining potential on the photosensitive drum 5, and a cleaner 15 formed of a brush 12 for removing the remaining toner on the photosensitive drum 5 and a collector roll 14 for recovering the toner dropped by the brush 12 and storing the toner to a lower section disposed with a collector spiral 13.

A registration roller 16 for conveying the sheet 2 fed from the feed roller 4*b* between the photosensitive drum 5 and the transfer unit 9 is arranged at the upstream side of the drum 5 with respect to the conveying direction of the sheet 2, and a suction conveying mechanism 18 for conveying the sheet separated from the photosensitive drum 5 by the separating corona charger 10 to a fixing unit 17 is arranged at the downstream side of the drum 5 with respect to the conveying direction of the sheet 2. The suction conveying mechanism 18 is formed, as shown in FIGS. 3 and 4, of a suction mechanism 19 and a conveying mechanism 20. One suction mechanism 19 is provided on its lower surface with a suction fan 22 in a box 21 of the size from the separating corona charger 10 to the fixing unit 17, and a number of suction holes 23 are opened at the lower surface of the box 21. The other conveying mechanism 20 is formed by exposing downward endless conveying belts 25 engaged between a pair of rotary rollers 25 and 25 from a plurality of long holes 24, 24 opened in parallel with the direction perpendicular to the conveying direction of the sheet 2 on the lower surface of the box 21. The fixing unit 17 contains a heat roll 27 and a rubber roller 28 rolling by pressing by the roll 27, and an exhaust sheet tray 29 for receiving the fixed sheets 2 is attached to the outlet side of the body 1.

In the electrophotographic printer described above, the sheet 2 of either one size of the cassettes 3 are selected, the sheet 2 is taken by the hopping roller 4*a*, and further conveyed toward the registration roller 16.

Then, after the photosensitive drum 5 is set by the corona charger 6 to a writable state, an electrostatic latent image is formed on the photosensitive drum 6 by the LED head 7 according to a predetermined print signal. Then, toner is adhered to the electrostatic latent image formed on the photosensitive drum 5 by the developing unit 8, and the toner is transferred to the lower surface of the sheet 2 fed by the registration roller 15 by the transfer unit 9. Thereafter, the sheet 2 is separated from the photosensitive drum 5 by the separating corona charger 10. Subsequently, the suction conveying mechanism 18 is driven to feed the sheet toward between the heat roller 27 and the rubber roll 28 of the fixing unit 21 while sucking the upper surface of the sheet to the lower surface of the conveying belt 25 of the conveying mechanism through the suction hole 23 by the negative pressure of the suction fan 22 of the suction mechanism 19. The sheet 2 is passed through the fixing unit 17 to be fixed with the toner image transferred thereby, and exhausted on the external exhausted sheet tray 29 of the printer body 1.

On the other hand, the photosensitive drum which has thus transferred is eliminated at the remaining potential on the surface thereof by the electric eliminator 11, the remaining toner on the surface of the photosensitive drum 5 is dropped by the brush 12, and the photosensitive drum 5 is then set again to a chargeable state. The toner dropped by the brush 12 is stored in the lower section by the cleaner 15 disposed with the collector spiral 13 by the collector roll 14.

However, in the printer of the constructiton described above, the transferred sheet 2 is sucked by the negative pressure from the suction hole 23 to the lower surface of the conveying belt 26 of the suction conveying mechanism 18 to be conveyed. Therefore, when an image is transferred to a normal sheet, the sheet can be preferably conveyed, but when the image is transferred to an envelope, it has such a problem that the envelope cannot be stably conveyed. More specifically, as shown in FIGS. 5(*a*) and 5(*b*), a cover 31 is foldably formed at one end edge of an envelope body 30 and the cover 31 is held in a state floated from the envelope body 30. Thus, as shown in FIG. 6, when it is sucked to the conveyor belt 26, only the cover 31 of th envelope body 30 is sucked, but the envelope body 30 cannot be suitably sucked. Therefore, it has a problem that the envelope body 30 cannot be positively sucked to the lower surface of the conveying belt 26 to be conveyed. Particularly, when the envelope body 30 is conveyed with the cover 31 disposed forward in a landscaping direction, this problem frequently occurs.

SUMMARY OF THE INVENTION

Accordingly, an object of this invention is to provide an electrophotographic printer which can eliminate the above-described disadvantages of the prior art and which can positively and stably convey a sheet of all types including an envelope toward a fixing unit when the sheet transferred with a toner image to its lower surface is conveyed while the sheet is sucked from the upper surface.

Another object of this invention is to provide an electrophotographic printer having a photosensitive drum disposed in a body for transferring an electrostatically adhered toner to the lower surface of a sheet, a fixing unit disposed at the downstream side of said photosensitive drum for fixing the toner transferred to the sheet, and a suction conveying mechanism disposed between said photosensitive drum and said fixing unit for conveying the sheet transferred with the toner by said photosensitive drum by sucking the sheet transferred with the toner from above comprising a retaining roller rotatably pressed in contact with the lower surface of the conveying belt of said suction conveying mechanism.

Still another object of this invention is to provide an electrophotographic printer having a housing, a sheet supply cassette for supplying sheets, an exhausted sheet tray for depositing printed sheets, a sheet conveying passage provided in said housing to connect said sheet supply cassette to said exhausted sheet tray, a photosensitive drum disposed at the lower side of said sheet conveying passage for forming an electrostatic latent image on the surface thereof, a developing unit for developing the electrostatic latent image formed on said photosensitive drum wih toner, a transfer unit provided at a position oppositely through said sheet conveying passage to said photosensitive drum for transferring the toner image developed by said developing unit to the lower surface of said sheet, a corona charger disposed adjacent to the downstream side of the transfer unit with respect to the sheet conveying direction for separating the sheet transferred with the toner image from said photosensitive drum, and a suction conveying mechanism or conveying the sheet separated from said photosensitive drum to the fixing unit.

According to this invention, an envelope having a cover to be scarcely conveyed can be conveyed in addition to a normal sheet by pressing the envelope by the retaining roller to the lower surface of the conveying belt. Thus, even if the envelope is conveyed from a landscaping direction, the envelope body can be conveyed without separating it from the conveying belt, and all types of sheets can be accordingly positively and stably conveyed.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

An embodiment of the present invention will be described in detail with reference to FIG. 1.

Figure 1:
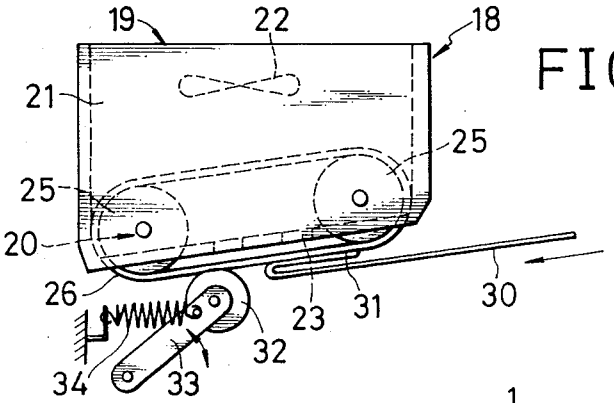
FIG. 1 is a front view of a conveying belt section showing an embodiment of an electrophotographic printer according to the present invention.
Figure 2:
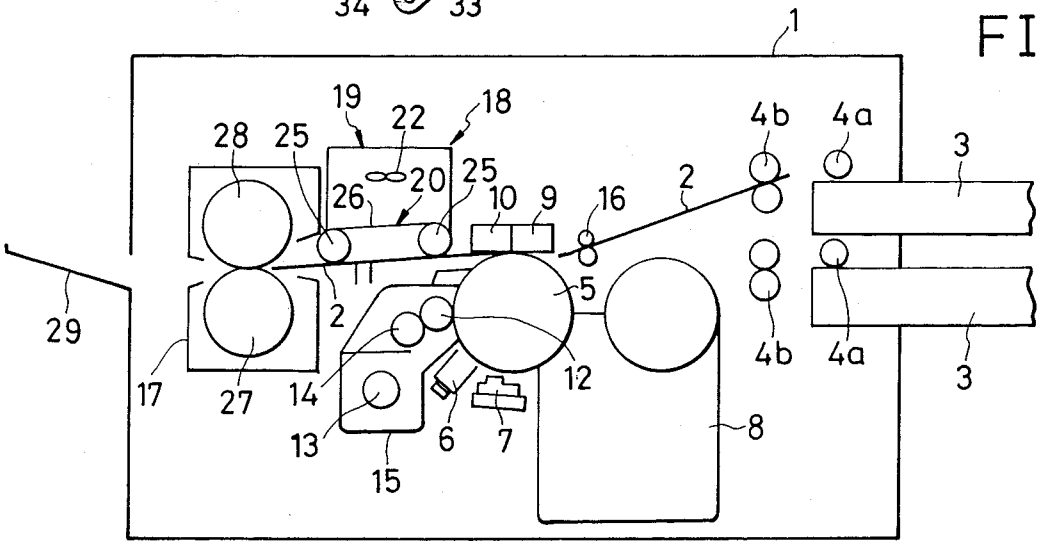
FIG. 2 is a schematic view of a construction of an example of an electrophotographic printer.
Figure 3:
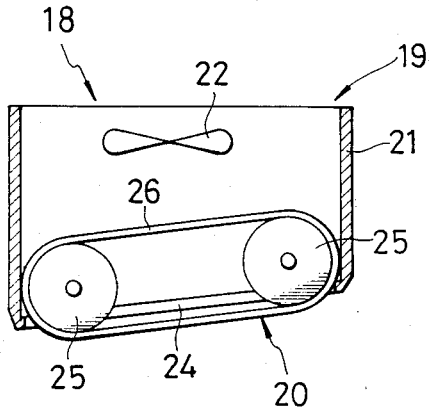
FIG. 3 is an enlarged longitudinal sectional view of part of FIG. 2.
Figure 4:
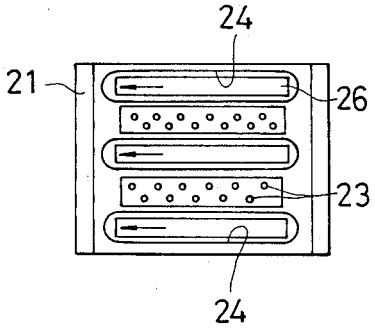
FIG. 4 is a bottom view of FIG. 3.
Figure 5A:
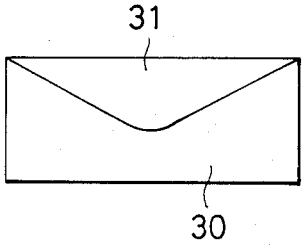
FIG. 5(a) (PRIOR ART)
FIG. 5(*a*) and 5(*b*) are front and side views of envelope.
Figure 5B:
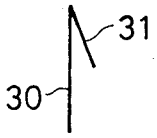
FIG. 5(b) (PRIOR ART)
Figure 6:
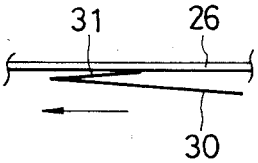
FIG. 6 is an explanatory view showing the conveying state of a conventional envelope.

FIG. 1 shows an embodiment of the present invention, wherein the same components as those in the conventional one are designated by the same or equivalent reference numerals.

In this embodiment, a retaining roller 32 is rotatably pressed in contact with a conveyor belt 26 under a suction conveying mechanism 18.

More particularly, a plurality of conveyor belts 26 engaged with a pair of rotary rollers 25 and 25 are arranged in parallel in a direction perpendicular to the conveying direction, exposed from the lower surface of a box 21 downward, and a number of suction holes 23, 23 for sucking a sheet or the like to the lower surface of the conveyor belt 26 are opened between the conveyor belts 26. The retaining roller 32 is rotatably attached to the upper end of an arm 33 pivotally secured at its lower end to the printer body 1. An energizing spring 34 is extended between the printer body 1 and the arm 33, and the retaining roller 32 is pressed by the spring 34 to the lower surface of the conveyor belt 25 by the energizing force of approx. 10 to 100 g/cm. The number of the retaining rollers 32 may be provided optionally, and the rollers 32 are provided, for example, at the position for pressing the conveyor belt 25 to one side end or both ends of an envelope body 30.

The operation of the embodiment will be described.

The case where the envelope 30 to be difficult heretofore to be conveyed is printed while conveying it in a landscaping direction will be described.

The envelope body 30 is conveyed toward the photosensitive drum 5 with the front surface without cover 31 disposed as a lower surface side, and a toner image is transferred to the lower surface by the transfer unit 9. Then, the envelope is separated from the photosensitive drum 5 by the separating corona charger 10, and conveyed continuously by the sucton conveying mechanism 18.

In the suction conveying mechanism 18, when the envelope body 30 is conveyed with the cover 31 disposed forward, the air is sucked from the suction hole 23 to suck the envelope 30 to the lower surface of the conveyor belt 26. Then, when the envelope body 30 is conveyed leftward of the drawing by the drive of the conveyor belt 26, the ends of the envelope body 30 and the cover 31 are inserted between the conveyor belt 26 and the retaining roller 32, and the envelope body 30 is conveyed by the conveyor belt 26 in the state retained by the retaining roller 32. At this time, the retaining roller 32 is rotated upon movement of the envelope body 30, and the envelope body 30 can be smoothly and positively conveyed.

On the other hand, when the sheet, such as the envelope is not conveyed, the retaining roller 32 is rotated in the state contacted with the conveyor belt 26.

In the embodiment as described above, when the envelope body 30 is conveyed, the envelope body 30 is pressed to the lower surface of the conveyor belt 26 by the retaining roller 32. Therefore, even when the envelope body 30 is conveyed in a landscaping direction, the envelope body 30 can be conveyed in a pressed state without separating it from the conveyor belt 26. Accordingly, in the embodiment, sheets of all types including the envelope can be positively and stably conveyed.

The present invention is not limited to the particular embodiment. Various other changes and modifications may be made within the spirit and scope of the present invention.

According to the present invention as described above, the electrophotographic printer of the invention is constructed and operated as mentioned before. When the sheet transferred with the toner image to the lower surface is conveyed while sucking the sheet from the upper surface, sheets of all types including the envelope may be, in addition to the normal sheets, positively and stably conveyed toward the fixing unit while sucking the sheet from the upper surface.

What is claimed is:

1. An electrophotographic printer having a photosensitive member disposed in a body for transferring an electrostatically adhered toner to the lower surface of a sheet, a fixing unit disposed at the downstream side of said photosensitive member for fixing the toner transferred to the sheet, and a suction conveying mechanism disposed between said photosensitive member and said fixing unit for conveying the sheet transferred with the toner by said photosensitive member by sucking the sheet transferred with the toner from above comprising a retaining roller rotatably pressed in contact with the lower surface of the conveyor belt of said suction conveying mechanism.

2. An electrophotographic printer according to claim 1, wherein said suction conveying mechanism comprises a plurality of conveyor belts and a number of suction holes.

3. An electrophotographic printer according to claim 1, wherein a plurality of said retaining roller are provided.

4. An electrophotographic printer comprising a housing, a sheet supply cassette for supplying sheets, an exhausted sheet tray for depositing printed sheets, a sheet conveying passage provided in said housing to connect said sheet supply cassette to said exhausted sheet tray, a photosensitive drum disposed at the lower side of said sheet conveying passage for forming an electrostatic latent image on the surface thereof, a developing unit for developing the electrostatic latent image formed on said photosensitive drum with toner, a transfer unit provided at a position oppositely through said sheet conveying passage to said photosensitive drum for transferring the toner image developed by said developing unit to the lower surface of said sheet, a corona charger disposed adjacent to the downstream side of the transfer unit with respect to the sheet conveying direction for separating the sheet transferred with the toner image from said photosensitive drum, and a suction conveying mechanism for conveying the sheet separated from said photosensitive drum to the fixing unit.

5. An electrophotographic printer according to claim 4, wherein a retaining roller rotatably pressed to the lower surface of said suction conveying mechanism is further provided.

* * * * *